US008800654B2

(12) United States Patent
Tverlid

(10) Patent No.: US 8,800,654 B2
(45) Date of Patent: Aug. 12, 2014

(54) WELLBORE MACHINING DEVICE

(75) Inventor: Steinar Wasa Tverlid, Bjørøyhamn (NO)

(73) Assignee: Statoil Petroleum AS, Stavanger (NO)

( * ) Notice: Subject to any disclaimer, the term of this patent is extended or adjusted under 35 U.S.C. 154(b) by 557 days.

(21) Appl. No.: 13/139,217

(22) PCT Filed: Dec. 12, 2008

(86) PCT No.: PCT/EP2008/010596
§ 371 (c)(1),
(2), (4) Date: Sep. 23, 2011

(87) PCT Pub. No.: WO2010/066276
PCT Pub. Date: Jun. 17, 2010

(65) Prior Publication Data

US 2012/0029702 A1 Feb. 2, 2012

(51) Int. Cl.

| | |
|---|---|
| ***E21B 47/00*** | (2012.01) |
| ***E21B 34/16*** | (2006.01) |
| ***E21B 19/00*** | (2006.01) |
| ***E21B 33/00*** | (2006.01) |
| ***E21B 17/10*** | (2006.01) |
| ***E21B 23/00*** | (2006.01) |
| ***E21B 44/00*** | (2006.01) |
| ***E21B 19/22*** | (2006.01) |
| ***E21B 10/64*** | (2006.01) |
| ***E21B 11/00*** | (2006.01) |

(52) U.S. Cl.
USPC ..... 166/254.2; 166/73; 166/85.1; 166/241.6; 166/250.15; 166/382; 175/24; 175/102; 175/257

(58) Field of Classification Search
CPC ..... E21B 7/208; E21B 23/01; E21B 23/10; E21B 44/005; B23G 1/22; Y10S 470/901
USPC ..... 175/24, 26, 92, 101, 102, 257–262, 57, 175/171; 166/67, 72, 73, 241.1, 166/241.5–241.7, 250.01, 250.15, 254.1, 166/254.2, 255.1, 85.1, 380, 382
See application file for complete search history.

(56) References Cited

U.S. PATENT DOCUMENTS 4,402,120 A * 9/1983 Haygood ..... 29/40
4,964,759 A 10/1990 Guzzetta et al.

(Continued)

FOREIGN PATENT DOCUMENTS

DE 199 16 302 A1 10/2000
GB 2 129 350 A 5/1984

(Continued)

*Primary Examiner* — Crystal J Barnes-Bullock
(74) *Attorney, Agent, or Firm* — Birch, Stewart, Kolasch & Birch, LLP

(57) ABSTRACT

A wellbore machining device is proposed for machining a tubular component of a wellbore. The device includes a control unit at the surface level of the wellbore and a down-hole tool unit connected to the control unit through a wire line. The tool unit includes an elongated guide member, a tool member movably supported on the guide member with respect to at least three axes of motion and a plurality of actuators controlled by the control unit and adapted to move the tool member with respect to the axes of motion. The tool unit further includes two anchor members each mounted to an axial end of the guide member and adapted to releasably clamp the tool unit to the tubular component. The control unit and the tool unit form a computer numerical control device (CNC device) wherein the actuators are electric servo motors controlling an actual position of the tool member with respect to a path and/or a sequence of desired position defined by the control unit.

19 Claims, 2 Drawing Sheets

(56) References Cited

U.S. PATENT DOCUMENTS

| | | | | |
|---|---|---|---|---|
| 5,183,365 | A | 2/1993 | Silk | |
| 5,411,301 | A * | 5/1995 | Moyer et al. | 285/333 |
| 5,779,406 | A * | 7/1998 | Astor | 409/132 |
| 6,397,959 | B1 | 6/2002 | Villarreal | |
| 7,036,610 | B1 * | 5/2006 | Vail, III | 175/57 |
| 7,140,445 | B2 * | 11/2006 | Shahin et al. | 166/380 |
| 7,284,617 | B2 * | 10/2007 | Pietras | 166/382 |
| 7,287,584 | B2 * | 10/2007 | Angman et al. | 166/177.4 |
| 7,303,022 | B2 * | 12/2007 | Tilton et al. | 166/380 |
| 7,334,650 | B2 * | 2/2008 | Giroux et al. | 175/26 |
| 7,458,616 | B2 * | 12/2008 | Reynolds, Jr. | 285/333 |
| 7,607,478 | B2 * | 10/2009 | Martinez et al. | 166/250.01 |
| 8,353,348 | B2 * | 1/2013 | Chitwood et al. | 166/302 |
| 8,573,296 | B2 * | 11/2013 | Levie | 166/241.1 |
| 2007/0175636 | A1 | 8/2007 | McAfee | |

FOREIGN PATENT DOCUMENTS

| | | |
|---|---|---|
| GB | 2 353 812 A | 3/2001 |
| WO | WO 92/09785 | 6/1992 |

* cited by examiner

WELLBORE MACHINING DEVICE

BACKGROUND OF THE INVENTION

1. Field of the Invention

The invention relates to a wellbore machining device and in particular a machining device for down-hole operation.

2. Background of the Invention

In drilling a wellbore or in oil production, there is a need for down-hole machining tubular components, for example of a production tubing or a casing down-hole the wellbore. To provide for a casing junction, a window has to be milled to the casing and a pipe branching off has to be trimmed and sealed to provide for a smooth transition. Another need is down-hole cutting of a casing or to provide support for a lock hanger. Another problem is cleaning and sealing leaking connections, for example of a production tubing and up to now down-hole welding of tubular components is a challenge.

From GB 2 129 350 A, a remotely controllable cutting apparatus is known to cut drainage slots into a liner down in a borehole. The apparatus comprises an elongated frame which can be clamped by hydraulic jacks to the liner. The frame is rotatably supported by the jacks and movably guides a cross table movably supporting a milling tool. The position of the milling tool is monitored through a television camera.

From GB 2 353 813 A, a wellbore machining device is known comprising a tool unit having a milling tool for cutting a hole into a casing at a position a junction is needed. The path on which the milling tool is moving while milling is controlled by a mechanical template defining the shape of the hole to be cut to the casing.

Known prior art down-hole machining devices are often subject to vibrations, which reduce efficiency and precision of the machining operation and in particular accelerate wear and increase machining time. For example, windows cut into a casing by prior art down-hole milling operation are often rough and cause damage to sophisticated equipment which thereafter has to be run through the window. Milling a window with such a device will be time consuming, in particular, since the milling operation often has to be interrupted and the tool has to be retracted to the surface level raising the time needed for tripping of the tool. Relocating the tool to the exact position is also time consuming.

SUMMARY OF THE INVENTION

It is a main object of the invention to provide a wellbore machining device which allows accelerated precision down-hole machining of a tubular component of a wellbore.

The wellbore machining device according to the invention is provided for machining a tubular component of a wellbore, in particular, a casing of the wellbore and comprises a control unit and a down-hole tool unit connected to the control unit through a wire line, wherein the tool unit comprises an elongated guide member and a tool member which is movably supported on the guide member and includes at least one machining tool supported on the tool member such that the machining tool is movable with respect to at least three axes of motion, wherein the tool unit further comprises a plurality of actuators controlled by the control unit and adapted to move the tool member and/or the at least one machining tool with respect to the axes of motion, wherein a first one of the axes of motion extend along the guide member, and wherein the tool unit further comprises two anchor members, each being mounted to an axial end of the guide member and being adapted to releasably clamp the tool unit to the tubular component. The machining device is characterized in that the control unit and the tool unit form a computer numerical control device (CNC device) wherein the actuators are electric servo motors controlling an actual position of the tool member with respect to a path and/or a sequence of desired positions defined by the control unit.

The anchor devices positively clamp the tool unit to the tubular component which is to be machined and suppress vibrations of the tool unit otherwise induced during the machining operation. Thus, the CNC device is capable of controlling not only the path the machining tool is moving but also the cutting rate, the moving velocity and the cutting depth to provide for precise and smooth working results. To enhance precision of the machining, the actuators are electric servo motors which provide for a closed-loop control of the position of the tool member and/or the at least one machining tool.

A time consuming factor of prior art down-hole machining is the need for precise relocation of the tool unit after a tripping action, for example for changing a tool on the surface level of the well bore or for later rework of a component. In a preferred embodiment of the invention, the tool member comprises a sensing device responsive to a reference mark provided at the tubular component, wherein the control unit is responsive to the sensing device to position the tool member relatively to the tubular component, or to recalculate operation coordinates after the exact measured location. The tool member preferably further comprises a marking device adapted to provide the tubular component at a defined position thereof with the reference mark. The marking device establishes a reference point fixed to the tubular component which allows the tool unit or preferably the tool member thereof, for example the mill or other tools to be relocated to an exactly defined position at a later stage. One can also envisage to provide a built-in reference mark or guide reference for every joint of the tubular component, for example every casing joint already during production of the tubular component to allow exact location of any spot also post installation. The reference mark can be a painting spot to be sensed by an optical sensor or any other sensable mark, for example a mark to be sensed by electromagnetic or magnetic or induction or nuclear based sensors, but preferably is a small pit or a small groove bored or milled to the surface of the tubular component by a suitable tool of the tool member. The sensing device may comprise any suitable sensor to detect the pit or groove. The sensor may be an optical sensor or a non-contact sensor or a probe having a stylus or the like. The reference mark provides for the origin of a coordinate system the CNC device uses for controlling the path of tool movement.

Since the movement of the tool is CNC-controlled, the machining device is easily adaptable to different types of machining tools. The tool member may comprise at least one milling device, for example to cut a window into the tubular component and/or at least one lathe device for example to shorten the tubular component and/or at least one welding device, for example, to join pipe sections or to fix a branch tube at a casing junction or to seal a leaking connection. The tool member may also comprise a cleaning or polishing device or may comprise a logging device to measure the result of the machining operation and further can comprise heating or cooling devices for example to harden or soften chemical substances used for sealing or cladding.

Known down-hole machining devices must be brought to the surface level for changing a worn tool or for changing the type of the tool. To avoid tripping, the tool unit preferably comprises a carriage guided on the guide member and a plurality of machining tools supported on the carriage and/or a plurality of machining tools supported on at least one of the anchor members to be transferred to the devices of the tool member by means of a suitable tool changing mechanism. The CNC device provides for changing the tool without the need for relocation of the tool unit thus improving the working capacity of the machining device according to the invention.

The carriage is guided on the guide member to be moved along the first axis of motion, and preferably the tool member and/or the at least one machining tool thereof is movably supported on the carriage with respect to at least a second one of the axes of motion extending transversely, in particular radially to the first axis of motion. Preferably, the carriage is rotatable with respect to the first axis of motion to provide for a third one of the axes of motion. To provide for the third axis of motion, the carriage can rotate together with the guide member with respect to the anchor members, but preferably, the carriage is rotatable with respect to the guide member to minimize machining tolerances. Possible fourth and fifth axes would typically be tilting of the machining tool in two perpendicular planes.

Debris from the machining operation, for example cuttings from a milling action, create a risk in the wellbore and can necessitate additional trips to remove the debris in order not to threaten subsequent drilling actions. In a preferred embodiment, at least one of the anchor members comprises a particle collector adapted to collect particles machined by the tool member from the tubular component. The particle collector which also may be provided at wellbore machining devices other than the devices described above collects debris from the machining operation like cuttings from milling and allows the debris to be brought to the surface together with the tool unit after the operation without contaminating the wellbore.

The particle collector preferably comprises a filtering device separating the particles from a flow of fluid passing through the tool unit and the particle collector. The fluid can be the drilling fluid otherwise used for the drilling of the wellbore. Preferably, the tubular component is a constituent part of a fluid delivery system, in particular of the drilling fluid delivery system providing the flow of fluid through the anchor devices and past the tool member. The particle collector can comprise a receptacle, for example a basket or the like and/or can comprise a magnetic collector adapted to retain steel particles. Preferably, the particle collector is associated to the anchor device remote of the wire line.

Preferably, the anchor members are adapted to be fluid-type sealed against the tubular component and a filtering device is associated with the anchor member adjacent the wire line to clean the fluid when entering the space between the anchor members. A pump may be associated with the filter device to force the fluid through an annulus between the guide member and the tubular component. The fluid flowing in the space between the anchor members provides for a cooling and cleaning action at the machining position of the tool member so that only cleaned fluid flushes the machining position of the tool member.

The fluid flows through the lower anchor member, e.g. the to anchor member remote of the wire line and exits through the particle collector out into the free well. To preserve volume, an equal amount of fluid must return through the down-hole tool unit up to the surface of the well. The fluid delivery system therefore comprises a fluid return conduit which extends through the guide member.

Preferably, the fluid return conduit is not connected to the surface level of the wellbore through a tubing to make tripping of the tool unit more easy. In order not to "short circuit" the inlet of the fluid at the upper anchor member and the upper outlet of the fluid return conduit, the fluid return conduit preferably outwardly extends beyond at least the "upper" anchor member. The extension freely opens into the tubular component at some distance from the upper anchor member. Of course, the fluid return conduit can be part of a tubing extending along the tubular component. The tubing can be in the form of a "coiled tubing" as it is known in the art.

BRIEF DESCRIPTION OF THE DRAWINGS

The invention will be described hereinafter in more detail and by way of example with reference to the accompanying drawings in which FIG. 1 schematically shows a longitudinal cross-section of a wellbore machining device.

DETAILED DESCRIPTION OF THE PREFERRED EMBODIMENTS

Figure 1:
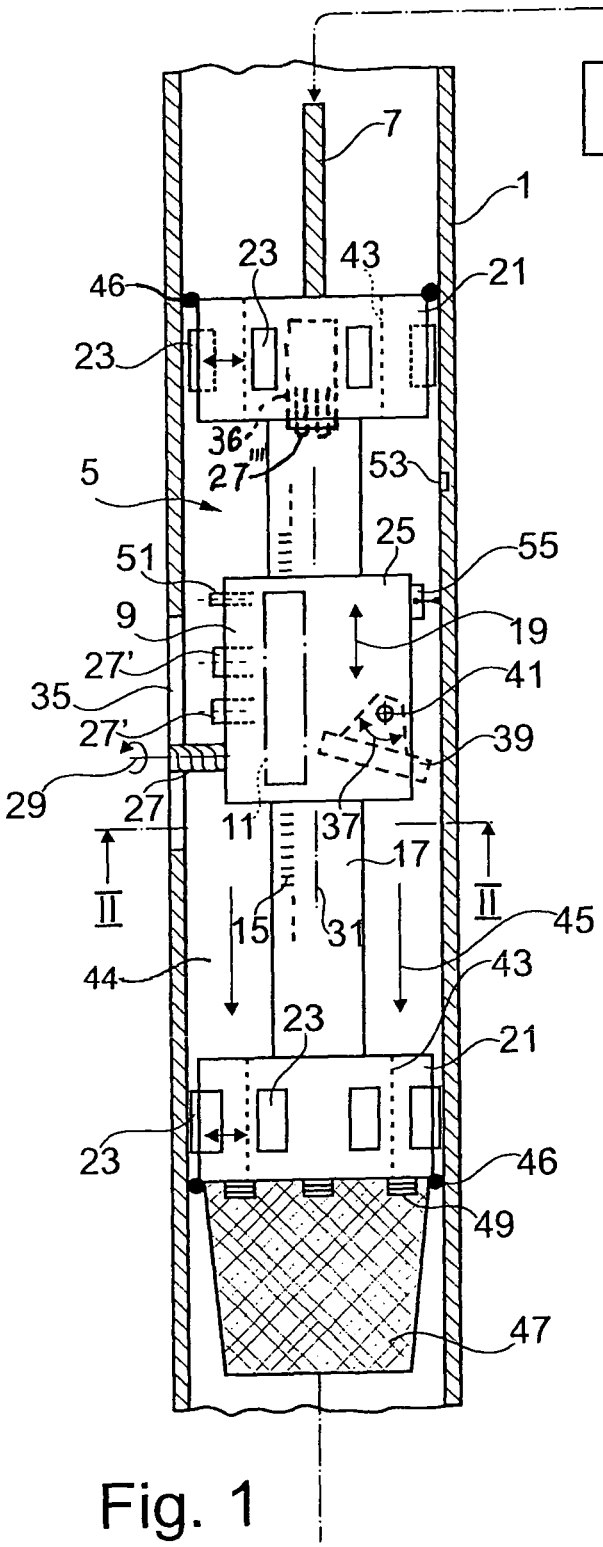
Figure 2:
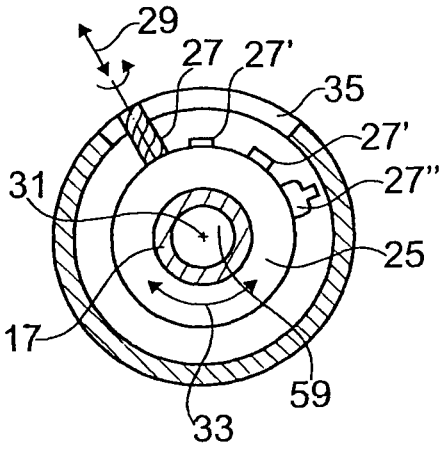
FIG. 2 schematically shows a cross-section of the machining device seen along a line II-II and FIG. 3 schematically shows a longitudinal cross-section of an embodiment of the wellbore machining device providing for an internal flow of fluid.

FIGS. 1 and 2 schematically show a machining device for machining a tubular component, here a casing 1 down-hole of a wellbore. The machining device comprises a control unit 3 at a surface level of the bore hole and a down-hole tool unit 5 connected to the control unit 3 via a wire line 7. The control unit 3 is in the form of a computer numerical control device (CNC device) and is adapted to control an actual position of a tool member 9 of the tool unit 5 and the actual position a plurality of machining tools along at least three axes of motion with respect to a path and/or a sequence of desired positions defined by data and a program stored in the down-hole tool unit 5 or in the surface control unit 3. The tool member 9 comprises actuators in the form of electric servo motors schematically indicated at 11, but not shown in detail, each of which comprises a position detector or the like sensing the actual position of the tool member. The position detector can sense the actual position, for example, with respect to a scale 15 at the path of a longitudinal movement of the tool member 9 or to a rotary encoder sensing the position of the electric motor or of a component driven by the motor or the like to provide for a closed-loop position control with respect of each of the axes of motion. Closed-loop position control is common in the art of CNC devices.

The tool unit 5 comprises a longitudinal cylindrical guide member 17 which guides the tool member 9 movably along a first axis of motion 19 co-axially with the axis of the casing 1. On both ends of the guide member 17 anchor members 21 are mounted each having a plurality of radially movable jacks 23 clamping the anchor member 21 towards the inner surface of the casing 1. The jacks 23 are driven by electric motors and release the anchor member in a radially retracted position thereof. The anchor members 21 support the tool unit 5 fixedly on the casing 1 to thus avoid vibrations during the machining operation. This enables the machining device to take advantage from the precision of the CNC control and provides for precise, smooth and efficient machining results.

As indicated at 36, a tool changing mechanism supporting a plurality of machining tools 27''' alternatively to or additionally to the machining tools shown at 27, 27' or 27'' can be provided on at least one of the anchor members 21. The tool changing mechanism is capable of storing a machining tool at a tool store and transferring individual tools between the tool store and the tool member 9, for example by means of a transfer belt (not shown). Of course, the tool changing mechanism can be provided on the tool member 9 itself to change tools at the individual machining devices thereof.

The tool member 9 comprises a carriage 25 carrying a plurality of machining tools, for example a milling device 27 having a milling tool rotating around an axis 29 radially to an axis 31 of the cylindrical guide member 17. The milling device 27 is movable along the axis 29 which thus forms a second axis of motion of the tool member 9. Further, the carriage 25 is rotatably supported on the guide member 17 with respect to the axis 31 to provide for a third axis of motion as indicated at 33 in FIG. 2. By controlling the actuators 11 of the tool member 9 along the three axes of motion 19, 29 and 33, for example a window opening 35 can be milled into the casing 1.

It is a benefit of CNC controlling the tool member 9 that the carriage 25 can support a plurality of machining tools or tool devices at different positions so that the control unit 3 can change the tool during the machining operation because differences in the position of the tools are stored in the memory of the control unit 3. As indicated at 27', not only tool devices of the same type can be provided on the carriage 25 for different formation and/or contingency purposes, but also tool devices for different machining purposes. For example, the tool unit 5 can comprise a welding device with at least one welding electrode 27" which is supported on the carriage 25 and is movable along at least three axes of motion. The tool member 9 can comprise at least one lathe tool to shorten the casing 1 while rotating the carriage 25 around the axis 31. Further, the tool devices can comprise logging devices (not shown) to measure the result of the machining operation or can comprise heating or cooling devices (not shown), for example, to harden or soften chemical substances used for sealing or cladding of the casing 1. The tool devices may also comprise a cleaning or polishing device (not shown) to clean or smoothen surfaces before or after the machining operation.

The tool devices can, of course, be supported on the carriage 25 movable along further axes of motion as indicated at 37 in the example of a tool device 39 pivotably supported on the carriage 25 at 41. For example a fourth axis and a fifth axis can be provided by tilting the tool in two perpendicular planes.

Figure 3:
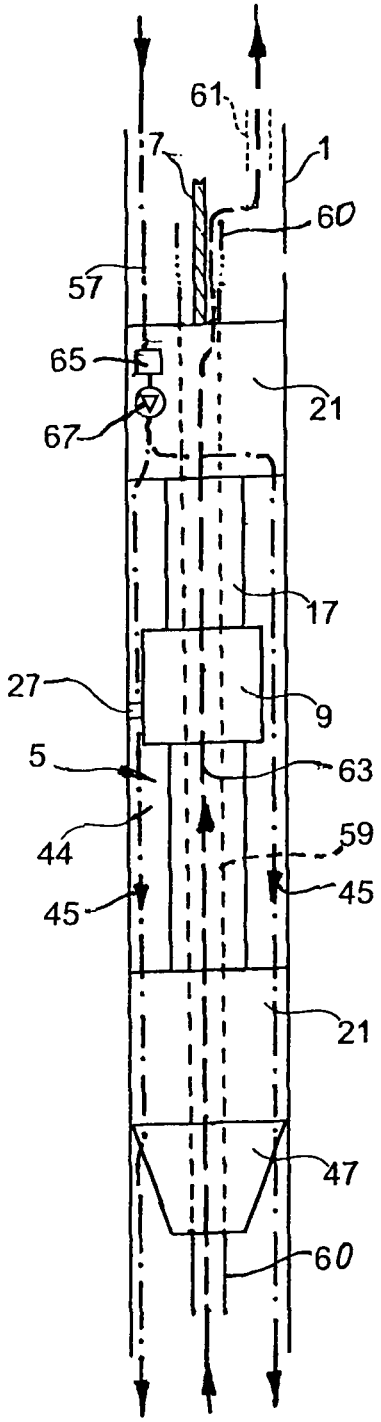

The casing 1 is a constituent part of a drilling fluid delivery system further explained also in conjunction with FIG. 3. The drilling fluid is pumped down-hole and flows through the tool unit 5 along openings 43 of the anchor member 21 and along an annulus 44 radially between the guide member 17 and the casing 1 (arrows 45). The drilling fluid is used to lubricate and to cool the machining action of the tool member 9. To prevent debris from the machining operation and, in particular, cuttings from the milling action from contaminating the wellbore as well as the cutting action itself, at least the anchor member 21 remote from the wire line 7 but preferably both anchor members 21 are sealed, for example, by means of an O-ring 46 or an expandable sealing ring against the casing 1 so that the total flow of drilling fluid must pass through the opening 43. The opening 43 of the anchor member 21 remote from the wire line, e.g. the "bottom" anchor member is covered by a particle collector preventing particles from exiting the tool unit 5. The particle collector comprises a basket-like filter 47 and at least one, here a plurality of, magnets 49 to better collect steel cuttings cut from the casing 1. The debris is brought to the surface together with the tool unit 5 after having finished the machining operation without contaminating the wellbore.

The tool member 9 is capable of being quickly and precisely relocated to an original position which the tool unit 5 left after a first machining step. The tool member 9 comprises a marking tool 51, for example, a small drilling tool or milling tool for producing a reference mark 53 in the form of a small pit or groove in the inner surface of the casing 1 at a position which is preferably defined by the control unit 3. For relocation of the tool unit 5 at the position defined by the reference mark 53, the tool member 9 is provided with a sensor device 55 adapted to detect the reference mark 53. The sensor device 55 may be an optical sensor or a non-contact sensor or, as it is shown in FIG. 1, a probe having a stylus for detecting the pit or groove of the reference mark 53. Of course, instead of a machined reference mark, other kinds of sensable reference marks may be used, for example, a painted spot or the like which is optically detected by an appropriate sensor as explained above. Of course, reference marks may also be provided on tube portions of the casing 1 before installing them in the well bore.

FIG. 3 shows details of the drilling fluid delivery system. The drilling fluid flows through the casing 1 down-hole and through the tool unit 5 including the anchor members 21 as explained in conjunction with FIG. 1. The down-hole flow of the drilling fluid is schematically shown by a dash-point line 57 and is guided through the anchor members 21 and the annulus 44. The down-hole flow exits the tool unit 5 through the particle collector 47 into the free well. To preserve the fluid volume in the well, a return flow of the drilling fluid is directed through a conduit 59 extending along and through the guide member 17 and the anchor member 21 (see also FIG. 2). The conduit 59 extends through the total length of the tool unit and comprises extension tubes 60 projecting outwardly from the tool unit 5. The extension tubes 60 open into the well and assure that a sufficient portion of the fluid exiting the lower anchor member 21 through the basket-like filter 47 or the upper anchor member 21 through the conduit 59 are not directly recycled or short-circuited in the vicinity of the anchor members 21. The extension tubes 60 provide for better heat dissipation of the fluid.

Of course, the extension tubes 60 may be omitted.

Since the return flow is not directed through a tubing to the surface level of the well, tripping of the tool unit 5 is very easy and not time-consuming. As may be easily understood, the conduit 59 may also be part of a fluid return system leading to the surface level of the well as indicated at 61 in FIG. 3. Preferably, the tubing is in the form of a "coiled tubing" extending between the tool unit 5 and the surface level of the well. But in principle, it is enough to control flow through tool unit 5 in both directions, and leave the drilling fluid live its own life outside tool unit 5. The return flow is schematically shown with a dashed line 63.

The down-hole flow of drilling fluid enters the annulus 44 through a filter 65 associated with the anchor member 21 adjacent the wire line 7, e.g. the "upper" anchor member. A pump 67 forces the drill fluid through the tool unit 5. In the embodiment of FIG. 3, the pump 67 is also associated with the upper anchor member 21, but may also be associated with the lower anchor member 21. The cleaned drilling fluid flowing down-hole the annulus 44 flushes and cools the machining tool 27 and washes debris and cuts into the basket-like particle collector 47.

The invention claimed is:

1. A wellbore machining device for machining a tubular component of a wellbore, the wellbore machining device comprising:

a control unit; and a down-hole tool unit connected to the control unit through a wire line, wherein the down-hole tool unit comprises: an elongated guide member, a tool member which is movably supported on the guide member and includes at least one machining tool supported on the tool member such that the machining tool is movable with respect to at least three axes of motion, a plurality of actuators controlled by the control unit and adapted to move the tool member and/or at least one machining tool thereof with respect to the axes of motion, wherein a first one of the axes of motion extends along the guide member, two anchor members each mounted to an axial end of the guide member and adapted to releasably clamp the down-hole tool unit to the tubular component, and a carriage guided on the guide member, wherein a plurality of machining tools are supported on the carriage and/or a plurality of machining tools are supported on at least one of the anchor members to be transferred to at least one of the devices of the tool member, wherein the control unit and the down-hole tool unit form a computer numerical control (CNC) device, and wherein the actuators are electric servo motors controlling an actual position of the tool member with respect to any of a path and a sequence of desired positions defined by the control unit.

2. The wellbore machining device according to claim 1, wherein the tool member comprises a sensing device responsive to a reference mark provided at the tubular component, and wherein the control unit is responsive to the sensing device to position the tool member relative to the tubular component.

3. The wellbore machining device according to claim 2, wherein the tool member further comprises a marking device adapted to provide the tubular component at a defined position thereof with the reference mark.

4. The wellbore device according to claim 1, wherein the tool member comprises any of a milling device, a lathe device, a welding device, a cleaning device, a polishing device, a logging device and a heating or cooling device.

5. The wellbore machining device according to claim 1, wherein the down-hole tool unit comprises a carriage guided on the guide member to be moved along the first axis of motion and the tool member and/or the at least one machining tool is movably supported on the carriage with respect to at least a second one of the axes of motion extending transversely, to the first axis of motion.

6. The wellbore machining device according to claim 5, wherein the carriage is rotatable with respect to the first axis of motion to provide for a third one of the axes of motion.

7. The wellbore machining device according to claim 1, wherein the down-hole tool unit comprises a particle collector adapted to collect particles machined by the tool member from the tubular component.

8. The wellbore machining device according to claim 1, wherein the tubular component is a constituent part of a fluid delivery system providing a flow of fluid through the anchor members and past the tool member, wherein the anchor members are adapted to be sealed in a fluid-tight manner against the tubular components and wherein a filtering device is associated with the anchor member adjacent the wire line to clean the fluid when entering the space between the anchor members.

9. The wellbore machining device according to claim 8, wherein a pump is associated with one of the anchor members.

10. The wellbore machining device according to claim 8, wherein the fluid delivery system comprises a fluid return conduit which extends through the guide member.

11. The wellbore machining device according to claim 10, wherein the fluid return conduit outwardly extends beyond at least one of the anchor members and freely opens into the tubular component.

12. The wellbore machining device according to claim 8, wherein the fluid return conduit is part of a tubing extending along the tubular component up to the surface level of the wellbore.

13. A wellbore machining device for machining a tubular component of a wellbore, the wellbore machining device comprising:

a control unit; and a down-hole tool unit connected to the control unit through a wire line, wherein the down-hole tool unit comprises:

an elongated guide member, a tool member which is movably supported on the guide member and includes at least one machining tool supported on the tool member such that the machining tool is movable with respect to at least three axes of motion, a plurality of actuators controlled by the control unit and adapted to move the tool member and/or a tool device thereof with respect to the axes of motion, wherein a first one of the axes of motion extends along the guide member, two anchor members each mounted to an axial end of the guide member and adapted to releasably clamp the down-hole tool unit to the tubular component, and a particle collector adapted to collect particles machined by the tool member from the tubular components, wherein the particle collector comprises a filtering device separating the particles from a flow of fluid passing through the particle collector.

14. The wellbore machining device according to claim 13, wherein the tubular component is a constituent part of a fluid delivery system providing a flow of fluid through the anchor members and past the tool member, wherein the particle collector comprises any of a receptacle and a magnetic collector associated with the anchor member remote from the wire line.

15. The wellbore machining device according to claim 13, wherein the tubular component is a constituent part of a fluid delivery system providing a flow of fluid through the anchor members and past the tool member, wherein the anchor members are adapted to be sealed in a fluid-tight manner against the tubular components and wherein a filtering device is associated with the anchor member adjacent the wire line to clean the fluid when entering the space between the anchor members.

16. The wellbore machining device according to claim 15, wherein a pump is associated with one of the anchor members.

17. The wellbore machining device according to claim 15, wherein the fluid delivery system comprises a fluid return conduit which extends through the guide member.

18. The wellbore machining device according to claim 17, wherein the fluid return conduit outwardly extends beyond at least one of the anchor members and freely opens into the tubular component.

19. The wellbore machining device according to claim 17, wherein the fluid return conduit is part of a tubing extending along the tubular component up to the surface level of the wellbore.

* * * * *